United States Patent [19]

Sandham

[11] 4,231,539

[45] Nov. 4, 1980

[54] PEDESTAL SEAT BASE

[75] Inventor: Edwin C. Sandham, Thiensville, Wis.

[73] Assignee: Leggett & Platt, Incorporated, Carthage, Mo.

[21] Appl. No.: 27,464

[22] Filed: Apr. 5, 1979

Related U.S. Application Data

[63] Continuation-in-part of Ser. No. 874,235, Feb. 1, 1978, abandoned.

[51] Int. Cl.[3] ..... F16M 13/00

[52] U.S. Cl. ..... 248/418; 248/415; 297/349

[58] Field of Search ..... 297/349; 108/142, 150; 248/418, 425, 417, 415

[56] References Cited

U.S. PATENT DOCUMENTS

| | | | |
|---|---|---|---|
| 1,547,849 | 7/1925 | Van Den Boogaard et al. | 108/142 |
| 2,106,650 | 1/1938 | Owler | 248/418 |
| 2,721,604 | 10/1955 | Salvadore et al. | 248/425 |
| 2,921,623 | 1/1960 | Humpheries et al. | 248/418 X |
| 3,107,891 | 10/1963 | Burke | 248/417 |
| 3,230,910 | 1/1966 | Olsson | 108/150 X |
| 3,926,396 | 12/1975 | Hall et al. | 297/349 X |
| 3,979,099 | 9/1976 | Strang | 248/418 |

*Primary Examiner*—Roy D. Frazier
*Assistant Examiner*—Robert W. Gibson, Jr.
*Attorney, Agent, or Firm*—Wood, Herron & Evans

[57] ABSTRACT

An improved seat base for a swivel type seat in which the base's seat support and pedestal are connected together in swivel relation by a thrust bearing of inverted conical configuration. In preferred form, a latch dog is movable between a latch position defined by a latch seat in the outer bearing collar for preventing swivel type rotation of the seat, and a release position where the latch dog is withdrawn from the latch seat into the interior of the thrust bearing for allowing swivel type rotation of tne seat. The latch dog is pivotable on a horizontal axis oriented above the thrust bearing between those two positions through a latch post in the inner bearing collar by use of a lift arm connected thereto, the lift arm having a handle located adjacent to the seat's front edge.

6 Claims, 4 Drawing Figures

PEDESTAL SEAT BASE

This application is a continuation-in-part of U.S. application Ser. No. 874,235, filed Feb. 1, 1978 now abandoned.

This invention relates to seat bases. More particularly, this invention relates to an improved pedestal seat base.

Pedestal seat bases are, of course, very well known to the art. Swivel type pedestal seat bases have been commonly used in the past in delivery vehicles, e.g., trucks and vans. Recently, however, such swivel type pedestal seat bases have been used in recreational vehicles, e.g., campers and the like. The primary function of a pedestal seat base is, of course, to permit the seat to swing or rotate relative to the vertical axis of the pedestal base when desired by the user. Such rotation is desirable, in a vehicle environment, for providing ingress to and egress from the seat by the vehicle's driver relative to the control panel and controls of the vehicle. In other words, the swinging motion of the seat allows the driver to enter into and exit from the seat with the seat swinging to a position 90° or more removed from the seat's front facing or normal driving position. It is also known to provide a locking device in combination with pedestal seat bases. The locking device functions to lock the pedestal seat base in a centered or front facing position so that the driver faces in the vehicle's travel direction, it being desirable that the seat not be able to swivel or rotate when the vehicle is underway. The lock device, therefore, is releasable when the driver wishes to get out of the seat or get into the seat so that the seat can be rotated to the side facing position. Typical of such prior art swivel seat bases are those illustrated in U.S. Pat. Nos. 3,979,099; 3,926,396; 3,855,764; 3,860,283; 3,858,834; and 3,758,063; these patents all have been recently issued, and all disclose pedestal seat base structures which are, according to those patents, particularly adapted for use in vehicle environments, e.g., vehicles such as vans or campers.

It has been the primary objective of this invention to provide an improved pedestal seat base which has a long useful life, i.e., a high resistance to failure, during use of that seat base in its intended environment, e.g., as a seat base for a vehicle, yet which provides a swivel function to permit the seat to swivel between a side facing or ingress/egress attitude and a front facing or driving attitude, and which provides a lock device to retain the seat in the front facing or driving attitude. In accord with this objective, the improved pedestal seat base of this invention is for a swivel type seat in which the base's seat support and pedestal are connected together in swivel relation by a thrust bearing of inverted conical configuration. In preferred form, a latch dog is movable between a latch position defined by a latch seat in the outer bearing collar for preventing swivel type rotation of the seat, and a release position where the latch dog is withdrawn from the latch seat into the interior of the thrust bearing for allowing swivel type rotation of the seat. The latch dog is pivotable on a horizontal axis oriented above the thrust bearing between those two positions through a latch post in the inner bearing collar by use of a lift arm connected thereto, the lift arm having a handle located adjacent to the seat's front edge.

Other objectives and advantages of this invention will be more apparent from the following detailed description taken in conjunction with the drawings in which.

Figure 1:
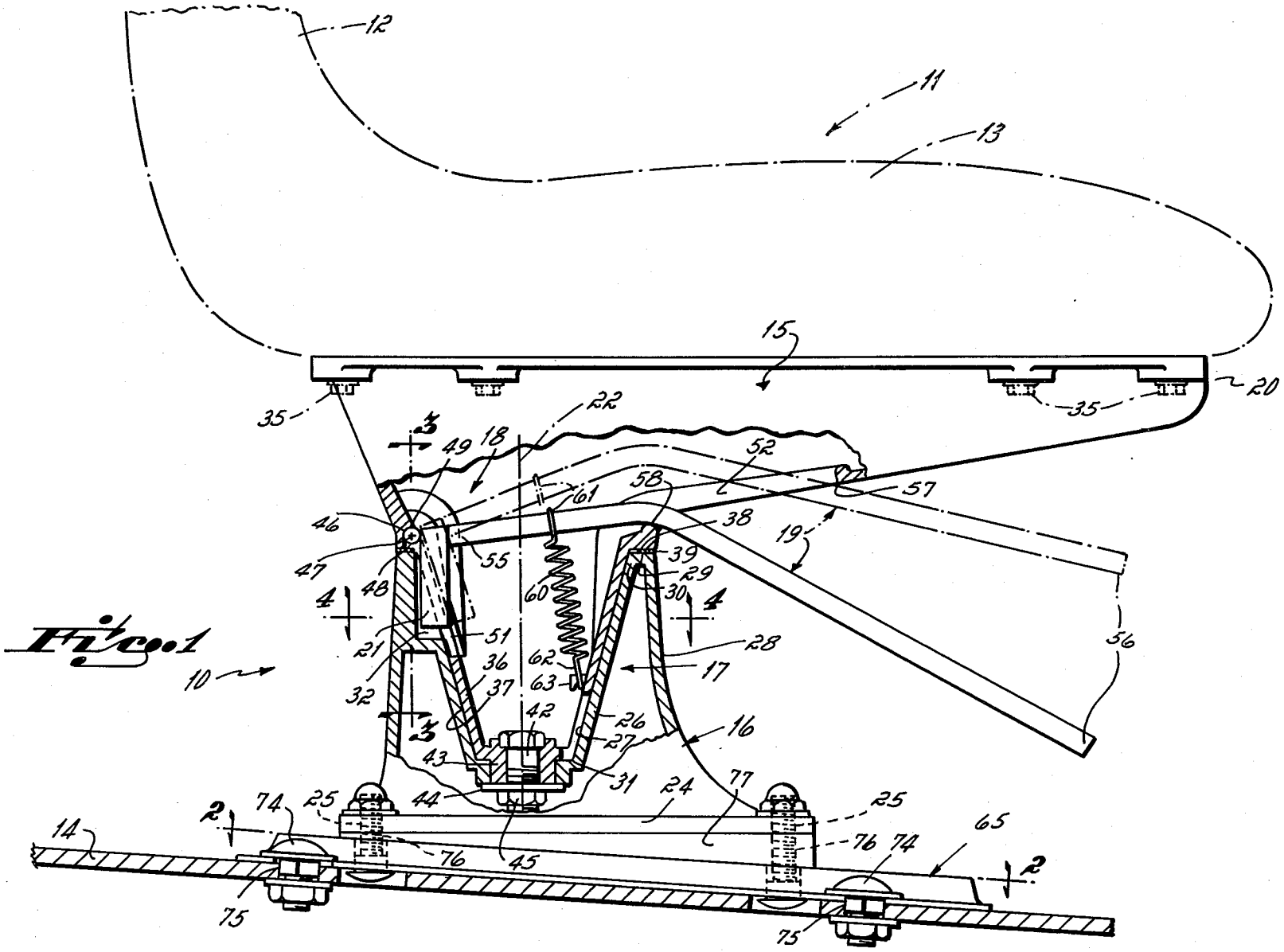
FIG. 1 is a partially broken away side view illustrating an improved pedestal seat base in accord with the principles of this invention.

The improved pedestal seat base 10 of this invention is shown generally in FIG. 1. As depicted in that figure, the improved base 10 is adapted for use with a seat 11 having a back rest 12 and a seat 13, the seat 11 per se forming no part of this invention, and being illustrated in phantom lines only. The improved pedestal seat base 10 itself is adpated for mounting on the floor 14 of a vehicle, e.g., van or recreational vehicle, for the purpose of positively locating and positioning the seat base (and, hence, the seat 11) in desired position relative to the control panel (not shown) and controls (not shown) of that vehicle.

The improved pedestal seat base 10 itself includes a seat support 15 and a pedestal 16, the seat support and pedestal being connected one with another through a vertical thrust bearing 17. The vertical thrust bearing 17, of course, allows the seat 11 to swivel or rotate relative to the center axis 22 of the pedestal 16 (which axis 22 also is the axis of the vertical thrust bearing). The improved pedestal seat base 10 also includes a latch device 18 having a lift arm 19 that extends adjacent to the front edge 20 of the seat 13, and having a latch dog 21 cooperate with the vertical thrust bearing 17 as more particularly described below. The latch device 18 allows the seat support 15 to be latched in a single position relative to the pedestal 16 when the latch device is latchingly engaged with the thrust bearing 17.

The pedestal 16 and part of the thrust bearing 17 may be fabricated as a one-piece aluminum casting, a base plate 24 with bolt holes 25 also comprising a part of the pedestal's one-piece casting. The vertical thrust bearing 17 includes an outer bearing collar 26 formed integral with the pedestal 16. The outer bearing collar 26 is of an inverted frusto conical configuration, and provides the fixed bearing surface 27 for the vertical thrust bearing. The outer bearing collar 26 is disposed with a generally cylindrical post 28, and is connected with the base plate 24 through that post 28. The joinder of the outer bearing collar 26 with the cylindrical support post 28 provides a flatted bearing surface 29 along the top edge thereof. Also, and particularly, the fixed outer bearing collar 26, which defines a tapered or inverted frusto conical bearing surface 27 between points 30 and 31 thereon, also defines a latch seat 32 adjacent the top edge 29 thereof in that fixed bearing surface 27, the latch seat being cast or formed integral with the pedestal 16 and, having a width W and a depth D, see FIGS. 1 and 3.

The seat support 15 is also of a one-piece configuration, and may be cast of, for example, aluminum, too. The seat support 15 is attached to the seat 13 by bolts 35. The seat support 15 also mounts or carries a part of the vertical thrust bearing 17. That portion of the vertical thrust bearing 17 carried by the seat support 15 is also of inverted frusto conical configuration, and is an inner bearing collar 36 sized and configured to mate with the pedestal's outer bearing collar 26, as shown particularly in FIG. 1. The inner bearing collar 36 presents a rotatable bearing surface 37 that is rotatable within and relative to the outer bearing surface 27. The inner bearing collar 36, which is formed integral with the seat support 15, terminates at its large diameter end with a flatted bearing surface or lip 38 adapted to overlie the flatted bearing lip 29 formed on the pedestal 16. A bearing washer 39 of, e.g., steel, is interposed between the seat support's flatted bearing lip 38 and the pedestal's flatted bearing lip 29 in assembly.

The seat support 15 and the pedestal 16 are retained in operational configuration, i.e., held together against vertical separation, by bolt 42 at the minor diameter ends 43 of the inner 36 and outer 26 bearing collars. The bolt 42 cooperates with washer 44 and nut 45, as shown in FIG. 1, to restrain the vertical thrust bearing in operational assembly and, thereby, to connect the seat support 15 and pedestal base 16 in operational assembly.

Figure 3:
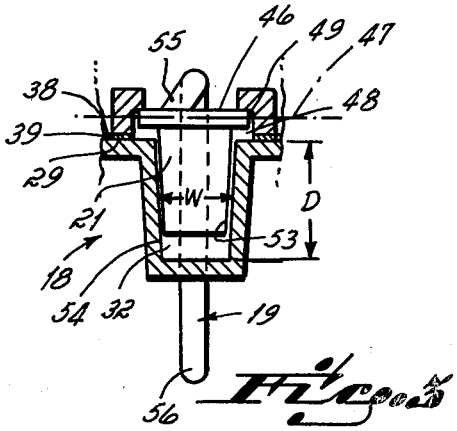
FIG. 3 is a cross-sectional view taken along line 3—3 of FIG. 1.
Figure 4:
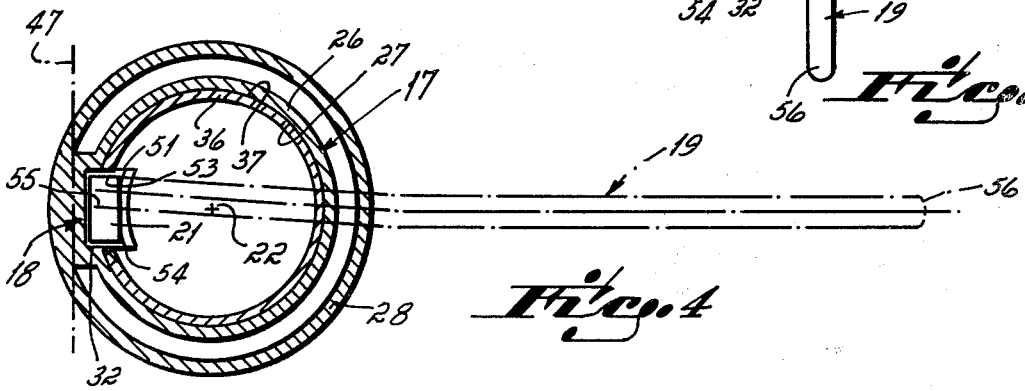
FIG. 4 is a cross-sectional view taken along line 4—4 of FIG. 1.

The latch device 18 by which the seat support 15 (and, hence, the seat 11) is retained in a pre-determined and desired swivel or rotational location relative to the center axis 22 of the vertical thrust bearing 17, i.e., the center axis of the improved pedestal base 10, is particularly illustrated in FIGS. 1, 3 and 4. The latch device 18 includes a latch dog 21 immobily fixed to a hinge pin 46, the hinge pin defining a hinge axis 47 for the latch dog that is transverse to the rotational axis 22 of the improved pedestal base 10. The hinge pin 46 is received in groove 48 defined in the flatted bearing lip 38 of the seat support 15. When the seat support 15 is assembled with the pedestal base 16, the hinge pin 46 is trapped between the grooved surface 49 defined in the seat support's flatted bearing lip 38, and the bearing washer 39 interposed between seat support's annular bearing surface 38 and the pedestal's annular bearing surface 29, all as illustrated in FIGS. 1 and 3, thereby locating the latch dog's hinge axis 47 beyond and above the major diameter 30 of thrust bearing 17. The latch dog 21 is so located in its hinged connection with the seat support 16 as to be able to pivot or move through latch port 51 defined through the inner bearing collar 36, see FIGS. 1 and 5, the latch port 51 in the inner bearing collar 36 being in the nature of a notch or cut-out defined therein. The latch dog 21 is, of course, thereby adapted to swing on horizontal axis 47 through the latch port 51 defined in the inner bearing collar 36 of thrust bearing 17.

As previously mentioned, the pedestal's outer bearing collar 26 defines latch seat 32, and this latch seat is sized to receive the latch dog 21 therein when the inner bearing collar's latch port 51 is circumferentially aligned with the outer bearing collar's latch seat. As shown in FIG. 3, that latch seat 32 is generally similar in configuration to the configuration of the latch dog 21 when viewed in a radial line of sight directed outwardly from the center axis 22 of the thrust bearing 17, and is of a width W, slightly greater than the width of the latch dog. When the latch dog 21 is received in the outer bearing collar's latch seat 32 and since the latch dog is connected to the seat support 15, the seat 11 is restrained against swinging or rotating motion relative to pedestal base 16 through abutment of the latch dog's side edges 53 with the side edges 54 of the latch seat 32 as shown in FIG. 4. As an alternate to the generally rectangular seat 32, the side edges 54 of the seat may be tapered (not shown) to eliminate play between the seat 32 and dog 21 when the two elements 32, 21 are latched in engagement.

The latch dog 21 is operated manually by the user of the seat 11 through lift arm 19, see FIG. 1. Lift arm 19 is in a dog leg configuration, and is immobily fixed to the latch dog 21 at one end 55. The other end 56 of the lift arm 19 is located adjacent to the front edge 20 of the seat 13, but underneath the seat, where it can be easily reached by the user of the seat 11. The lift arm 19 extends generally across the diameter of the thrust bearing 17, as viewed in FIG. 4, out through arm port 52 in the underside of the seat support casting 15. The arm port 52 is sized to provide locater stops 57, 58 at the front end and at the rear end thereof, respectively. When the lift arm 19 is abutted against the front end locator stop 57, the latch dog 21 is released from latching relation with the thrust bearing 17 as shown in phantom lines in FIG. 1, and when the lift arm 19 is abutted against rear end locator stop 58 the latch dog is disposed in the outer bearing collar's latch seat 32 as shown in solid lines in FIG. 1. Note particularly, with reference to the front edge 20 of the pedestal base (which, in effect, is equivalent to the front edge of the seat 13), that the latch seat 32 is located on the rear face of the vertical thrust bearing's outer bearing collar 26, and that the lift arm 19 thereby transverse a generally diametrical path across the thrust bearing 17, and across front face of the outer bearing collar 26 to the handle section 56, the entire lift arm 19 also thereby being located beyond and above the major diameter of the vertical thrust bearing 17. A tension spring 60 connects at one end 61 to the lift arm 19 and at the other end 62 to stud 63 formed integral with the inner bearing collar 36. The tension spring 60 constantly biases the lift arm 19 toward the latching attitude illustrated in FIG. 1.

Figure 2:
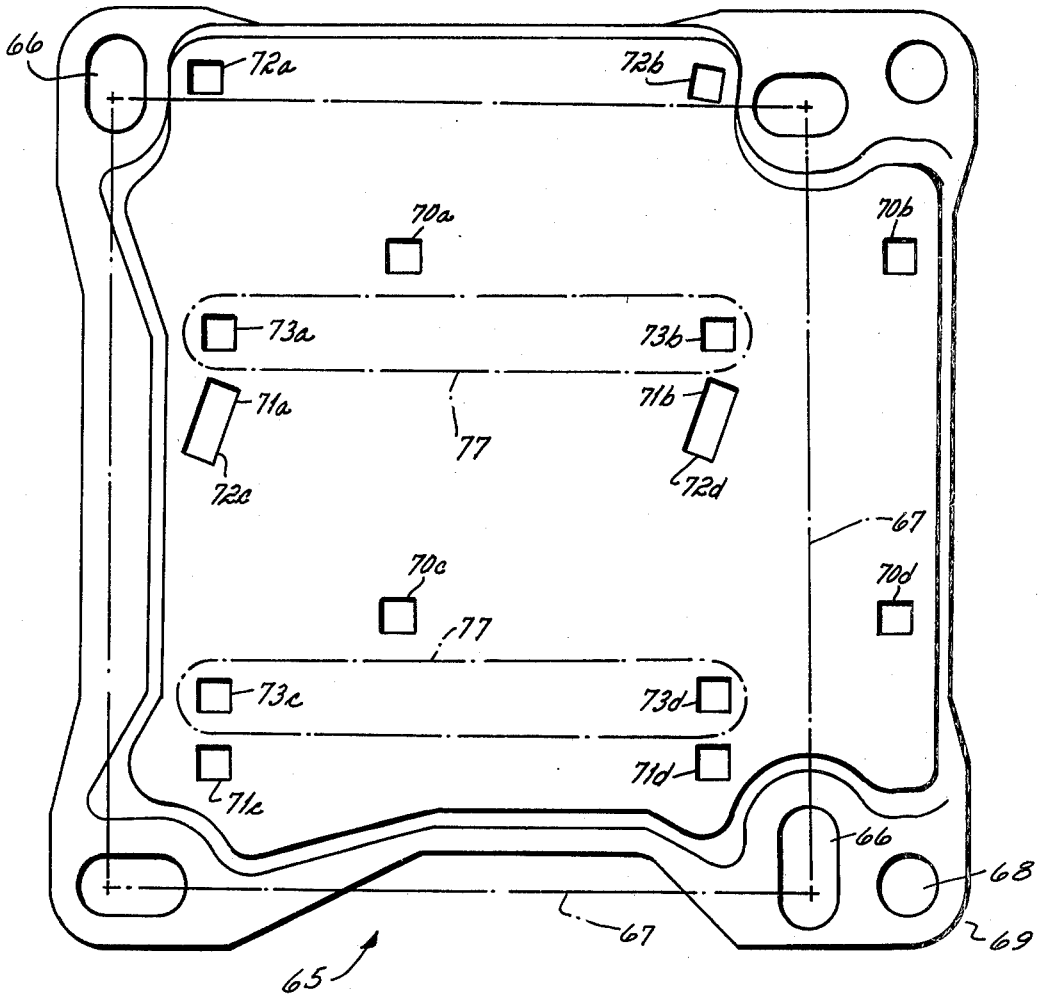
FIG. 2 is a top view of the floor plate taken along line 2—2 of FIG. 1.

The pedestal seat base 10 is connected to the floor 14 of a vehicle by use of an adaptor plate 65 particularly shown in FIG. 2. The adaptor plate 65 includes elongated bolt holes 66 at each of the four corners thereof, the longitudinal axes 67 of the bolt holes being oriented in a generally square configuration, and two supplemental circular bolt holes 68 at the front corners 69 of the adaptor plate. The adaptor plate 65 is also provided with four sets 70–73 of holes, each set of holes being comprised of four separate holes 70*a*–70*d*, etc., adapted to cooperate with the four bolt holes 25 in the pedestal base 16. The four sets 70–73 of bolt holes, as is apparent from FIG. 2, are set in the base plate 24 at four widely different locations on that adaptor plate. In the case of two sets 71, 72 of the bolt holes 70–73, the same share an elongated pair of bolt holes 71*a*, 72*c* and 71*b*, 72*d*. The four sets 70–73 of bolt holes are provided to allow the correct centering of the pedestal seat base 10 relative to controls of the recreational vehicle when the base is installed on the floor 14 of the vehicle. The adaptor plate 65 is commonly mounted to the vehicle floor 14 in a fixed position by mounting bolts 74 and bolt holes 75. However, the pedestal seat base 10 can be connected to that adaptor plate in a forward position by bolt hole set 70 or any of three rearward positions by any of the three bolt hole sets 71–73. And, in the rearward position, the pedestal seat base 10 can be located in a generally center location achieved through bolt hole set 73 to a right side location achieved by bolt hole set 71 or a left side location achieved by bolt hole set 72, all as desired by the user of the vehicle. Also in this connection, wedges 77 with bolt holes 76 may be interposed between the base plate 24 of the pedestal base 16 and the adaptor plate 65 if desired by the user, depending on the make of the vehicle in which the pedestal seat base 10 is installed, to insure horizontal alignment of that pedestal seat base 10 after installation. The wedges 75 are simply interposed between the base plate 24 and the adaptor plate 65 on each side of the base plate 24, as shown in FIG. 2. Seat base bolts 77 connect the pedestal base's base plate 24 with the adaptor plate 65, and restrain the wedges in fixed combination therewith, see FIG. 1. The multi-sets 70–73 of bolt mounting holes in the adaptor plate 65, and the wedges 75, allows a single adaptor plate to be provided to the pedestal base 10 purchaser, the desired set of bolt holes 70–73 then being selected by the purchaser depending on the make of vehicle with which the pedestal seat base 10 is to be installed.

In use, and with the improved pedestal seat base 10 aligned in the driving or front facing position shown in FIGS. 1, 3 and 4, the latch dog 21 pivots through the latch port 51 in the thrust bearing's inner bearing collar 36 into latch relation with the latch seat 32 defined in the fixed bearing surface 27 of the thrust bearing's outer bearing collar 26, thereby preventing the seat support 15 (and, hence, the seat 11) from swiveling or rotating relative to the pedestal base 16. The latch dog 21 is retained in this latching position through use of tension spring 60. When it is desired to swivel or rotate the seat 11 relative to the pedestal 16, the lift arm 19 is lifted vertically upward from the solid line position into the phantom line position as shown in FIG. 1, thereby pivoting the latch dog 21 through the inner bearing collar's latch port 51 out of the outer bearing collar's latch seat 32. In this phantom line position the seat 11 can swivel or rotate on the pedestal base 16 through use of vertical thrust bearing 17. Once the lift arm 19 is released, and if the seat 11 is not in the front facing attitude shown in FIGS. 1, 3 and 4, the latch dog 21 is simply spring 60 biased through the inner bearing collar's port 51 against the fixed bearing surface 27 of the outer bearing collar 26. When the chair is swiveled from, e.g., a side facing attitude (not shown) back to the front facing attitude, and since the latch dog 21 is spring 60 loaded, the latch dog 21 automatically seats in the outer bearing collar's latch seat 32 once the seat has been returned to the front facing position shown in FIGS. 1, 3 and 4.

Having described in detail one preferred embodiment of my invention, various changes and modifications will be apparent to persons skilled in the art. Therefore, what I desire to claim and protect by Letters Patent is:

1. An improved pedestal base for a seat comprising a seat support and a pedestal, said seat support being connectable with said seat, and said pedestal being connectable with a support surface, a vertical thrust bearing partially carried by said seat support and partially carried by said pedestal, said vertical thrust bearing comprising an inner bearing collar and an outer bearing collar, said inner and outer bearing collars defining side walls having a generally conical cross-sectional configuration, and said inner and outer bearing collars being nested one within the other so that the side walls of said bearing collars function as bearing surfaces, and a latch device for restraining said seat support and said pedestal in a centered position, said latch device comprising a latch dog movable through a latch port defined in the conical side wall bearing surface of one of said bearing collars into a latch port defined in the conical side wall bearing surface of the other of said bearing collars for preventing rotation of said seat support relative to said pedestal by latching said seat support in a preferred position, and a handle connected to said latch dog for allowing rotation of said seat support relative to said pedestal by removing said latch dog from latching relation with said latch seat.

2. An improved pedestal base as set forth in claim 1, said latch dog being hingedly connected to said inner bearing collar, said latch port being defined in said inner bearing collar, and said latch seat being defined in said outer bearing collar.

3. An improved pedestal base as set forth in claim 2, said latch seat being of a width only slightly greater than the width of said latch dog.

4. An improved pedestal base as set forth in claim 3, said latch dog hinged connection defining a horizontal axis transverse to the rotational axis of said vertical thrust bearing.

5. An improved pedestal base as set forth in claim 4, said handle extending adjacent the front edge of said pedestal base for manual operation.

6. An improved pedestal seat base as set forth in claim 2, said inner bearing collar being formed integral with said seat support and said outer bearing collar being formed integral with said pedestal.

* * * * *

UNITED STATES PATENT AND TRADEMARK OFFICE

CERTIFICATE OF CORRECTION

PATENT NO. : 4,231,539

DATED : November 4, 1980

INVENTOR(S) : Edwin C. Sandham

It is certified that error appears in the above—identified patent and that said Letters Patent is hereby corrected as shown below:

In the abstract, at line 10, change "tne" to --the--.

In column 2, line 18, change "adpated" to --adapted--.

In column 4, line 24, change "transverse" to --traverses--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*